US007038392B2

(12) United States Patent
Libsch et al.

(10) Patent No.: US 7,038,392 B2
(45) Date of Patent: May 2, 2006

(54) ACTIVE-MATRIX LIGHT EMITTING DISPLAY AND METHOD FOR OBTAINING THRESHOLD VOLTAGE COMPENSATION FOR SAME

(75) Inventors: Frank Robert Libsch, White Plains, NY (US); James Lawrence Sanford, Hopewell Junction, NY (US)

(73) Assignee: International Business Machines Corporation, Armonk, NY (US)

( * ) Notice: Subject to any disclaimer, the term of this patent is extended or adjusted under 35 U.S.C. 154(b) by 197 days.

(21) Appl. No.: 10/672,373

(22) Filed: Sep. 26, 2003

(65) Prior Publication Data

US 2005/0067970 A1 Mar. 31, 2005

(51) Int. Cl.
*G09G 3/10* (2006.01)

(52) U.S. Cl. ..... 315/169.3; 315/169.1; 345/98; 345/94; 345/99; 345/208

(58) Field of Classification Search ..... 315/169.3, 315/169.1, 169.2; 345/78, 82, 90, 92, 94, 345/99, 208, 55
See application file for complete search history.

(56) References Cited

U.S. PATENT DOCUMENTS

| | | | | |
|---|---|---|---|---|
| 6,229,506 | B1 | 5/2001 | Dawson et al. | 345/82 |
| 6,229,508 | B1 | 5/2001 | Kane | 345/82 |
| 6,348,906 | B1 * | 2/2002 | Dawson et al. | 345/82 |
| 6,359,605 | B1 * | 3/2002 | Knapp et al. | 345/76 |

OTHER PUBLICATIONS

Dawson, R.M.A., et al., *Design of an Improved Pixel for a Polysilicon Active–Matrix Organic LED Display*, SID 98 Digest, pp. 11–14.

Dawson, R.M.A., et al., *The Impact of the Transient Response of Organic Light Emitting Diodes on the Design of Active Matrix OLED Displays*, International Electron Devices Meeting, Dec. 6–9, 1998, San Francisco, CA.

Hattori, Reiji, et al., *Current–Writing Active–Matrix Circuit for Organic Light–Emitting Diode Display Using a–Si:H Thin–Film–Transistors*, IEICE Trans. Electron., vol. E83–C, No. 5, May 2000, pp. 779–782.

He, Yi, et al., *Electrical Reliability of Two– and Four–a–Si:H TFT Pixel Electrode Circuits for Active–Matrix OLEDs*, SID 2000 Digest, pp. 354–357.

Dawson, R.M.A., et al., *A Poly–Si Active–Matrix OLED Display with Integrated Drivers*, SID 98 Digest, pp. 438–441.

Wu, Biing–Seng, et al., *A Novel Depletion–Gate Amorphous Silicon Thin–Film Transistor*, IEEE Electron Device Letters, vol. 13, No. 1, Jan. 1992, pp. 17–19.

* cited by examiner

*Primary Examiner*—Haissa Philogene
(74) *Attorney, Agent, or Firm*—Daniel P. Morris

(57) ABSTRACT

An active matrix display includes a plurality of pixels arranged in an array, a first transistor and a second transistor associated with each pixel, the first and second transistors positioned within the array for controlling current flow through each pixel, a light emitting diode associated with each pixel; and a storage capacitor associated with each pixel, wherein, during a time period for establishment of a threshold voltage on the storage capacitor for the first transistor, a voltage equal to the sum of the threshold voltage and a voltage for compensating for turnoff of the second transistor is established on the storage capacitor.

37 Claims, 4 Drawing Sheets

ACTIVE-MATRIX LIGHT EMITTING DISPLAY AND METHOD FOR OBTAINING THRESHOLD VOLTAGE COMPENSATION FOR SAME

BACKGROUND OF THE INVENTION

1. Field of the Invention

The present invention relates to the formation of a uniform, light emitting, active matrix display and, more particularly, to an active-matrix light emitting display utilizing a less time consuming $V_t$ compensation method that does not require switching of the OLED cathode voltage.

2. Description of the Related Art

Displays for computer and video devices are well-known in the art and may consist of, for example, liquid crystal or light emitting diodes (LEDs). The displays may consist of a number of display elements or pixels arranged in rows and columns to form a matrix on glass. In a passive matrix, signals are applied to a row line and a column line to illuminate a pixel formed at the intersection of the row and column line. In an active matrix, pixels formed at the intersection of row and column lines may consist of an organic LED (OLED), for example, connected to at least one thin-film transistor (TFT). Some known configurations incorporate two, three and four TFTs per pixel (2-TFT, 3-TFT, 4-TFT). The OLED connected TFT acts to continuously control the amount of current flowing through the OLED based on data signals concerning the displayed image received by the TFT. In contrast with the passive display, the OLED in an active display may operate at all times, and since the TFT controls current flow for each OLED, the high currents necessary for a passive display are not required.

The use of organic materials in the electronics industry has increased in recent years and has led to low cost, high performance displays. Enhanced performance, such as increased luminance, has been achieved using OLEDs. Active-matrix OLEDs (AMOLEDs) have been developed, resulting in brighter, larger and higher resolution OLED displays that dissipate less power than passive-matrix displays. Further, an OLED display, unlike a liquid crystal display (LCD), allows for illumination of activated pixels only, so as to conserve power by not illuminating off pixels.

A problem exists, however, in that driving an OLED increases electrical stress beyond the electrical stress that is normally induced when driving liquid crystal. As a result, the threshold voltage ($V_t$) of the TFT will most likely increase. $V_t$ is the minimum voltage applied to the gate and source of a TFT that is required to open a conductive channel between source and drain so that current may pass between same. An increase in $V_t$ causes less current to pass through the OLED, thereby decreasing the OLED's brightness.

It is known that the $V_t$ of TFTs varies over time with electrical stress, and, in most instances, $V_t$ increases with electrical stress. Pixel structures to reduce the effect of $V_t$ variations are known. For example, for AMOLEDs, pixel circuitry using polysilicon (p-Si) active-matrix pixel circuits to minimize the impact of $V_t$ variations on OLED pixel luminance has been proposed. However, while rudimentary timing signals depicting data in the form of voltage and current are known, the known pixel circuitry does not provide for a simple driving method for incorporating a complex multiple TFT pixel circuit into a full size display.

Other techniques use data current drivers with TFTs to compensate for variations in $V_t$ and mobility. Data current drivers must be custom designed for the display system with which they are used, and, as a result, data current drivers are expensive and not available off the shelf. On the other hand, data voltage drivers, which are commonly used in active matrix liquid crystal dispalys, are available at low cost.

It is known that the carrier (electron and hole) mobility of a p-Si TFT is approximately 10× to 100× higher than that obtained with amorphous silicon (a-Si) TFTs. Upon fabrication, p-Si TFTs have higher mobility and $V_t$ variations due to physical variations in grain size and boundaries. The $V_t$ and mobility of a p-Si TFT varies only somewhat with electrical stress. In contrast, manufacturing variations in grain size and boundaries with a-Si TFTs, if any, do not cause appreciable variations in mobility and $V_t$. However, the $V_t$ in a-Si TFTs varies significantly with electrical stress. Mobility in a-Si TFTs does not vary significantly with electrical stress. Given the different properties between p-Si and a-Si TFTs, a current data driving method for $V_t$ compensation is compatible with p-Si TFTs since it is easier to correct mobility variations with a current data driving method than a voltage data driving method. It follows that a voltage data driving method for $V_t$ compensation is compatible with a-Si TFTs since mobility does not vary initially or significantly with electrical stress.

Data voltage a-Si TFT pixel circuits for $V_t$ compensation have been proposed. However, in the known data voltage a-Si TFT pixel circuits, the amount of time needed to set the $V_t$ compensation voltage is large and requires switching of the OLED cathode voltage (or the power supply source of current connection). Switching of the OLED cathode voltage can be cumbersome, requiring multiple power supplies using low on-resistance power transistors for switching from one power supply to another. The time required for setting $V_t$ can be as long as 1 millisecond. This time erodes the time left in a frame for writing and presenting data. In addition, because the cathodes of each OLED in the display are common or connected together, electrical magnetic interference (EMI) with switching the OLED cathode voltage is another system design issue. As a result, the need to switch cathode voltage adds cost to display systems.

Therefore, there exists a need for an active-matrix TFT light emitting display utilizing a less time consuming $V_t$ compensation method that does not require switching of the OLED cathode voltage.

BRIEF SUMMARY OF THE INVENTION

An active matrix display, in accordance with the present invention, includes a plurality of pixels arranged in an array, a first transistor and a second transistor associated with each pixel, the first and second transistors positioned within the array for controlling current flow through each pixel, a light emitting diode associated with each pixel, and a storage capacitor associated with each pixel, wherein, during a time period for establishment of a threshold voltage on the storage capacitor for the first transistor, a voltage equal to the sum of the threshold voltage and a voltage for compensating for turnoff of the second transistor is established on the storage capacitor.

In alternate embodiments, the display may further include a plurality of signal lines associated with each pixel for carrying signals for controlling the first and second transistors, and a plurality of power connections associated with each pixel for supplying power to each pixel. A voltage on a positive connection of the plurality of power connections may be greater than or equal to the total of a maximum voltage on a data signal line of the plurality of signal lines, a maximum voltage on the light emitting diode, and a voltage on a negative connection of the plurality of power connections. The maximum voltage on the data signal line may correspond to a maximum luminance of the light emitting diode and a minimum voltage on the data signal line may correspond to zero luminance of the light emitting diode. The voltage on the negative connection may be greater than or equal to the total of the negative of a minimum threshold voltage of the first transistor and the negative of an illumination onset voltage of the light emitting diode. The voltage on a reverse bias connection of the plurality of power connections may be less than the negative of a maximum threshold voltage of the first transistor.

The time period for setting $V_t$ may be between approximatley 100 microseconds and 200 microseconds. The second transistor may be turned on at a beginning of the time period and turned off at a predetermined point after the beginning and before an end of the time period. The first transistor may be turned on at the same time that the second transistor is turned off. The display may further include a third transistor associated with each pixel that is turned on and off at the same time that the second transistor is turned on and off, respectively.

A voltage on the storage capacitor may be reduced to establish the voltage equal to the sum of the threshold voltage for the first transistor and the voltage for compensating for turnoff of the second transistor. The light emitting diode may include organic material, and the first and second transistors may include thin-film transistors made from amorphous silicon. The plurality of signal lines may include a data signal line, a gate signal line, an on/off signal line, and a reverse bias voltage signal line. The plurality of power connections may include a positive connection, a negative connection and reverse bias connection, wherein the positive, negative and reverse bias connections do not change their respective voltage levels during the time period for establishment of the threshold voltage on the storage capacitor.

A method for obtaining threshold voltage compensation in pixels of an active matrix display, in accordance with the present invention, includes providing a plurality of pixels arranged in an array, wherein each pixel includes a first transistor, a second transistor, a light emitting diode, and a storage capacitor associated therewith, positioning the first and second transistors within the array for controlling current flow through each pixel, and establishing on the storage capacitor a voltage equal to the sum of a threshold voltage for the first transistor and a voltage for compensating for turnoff of the second transistor.

In alternate embodiments, the step of establishing may occur during a time period for establishment of the threshold voltage for the first transistor. Each pixel may include a plurality of signal lines associated therewith for carrying signals for controlling the first and second transistors, and each pixel may include a plurality of power connections associated therewith for supplying power to each pixel. A voltage on a positive connection of the plurality of power connections may be greater than or equal to the total of a maximum voltage on a data signal line of the plurality of signal lines, a maximum voltage on the light emitting diode, and a voltage on a negative connection of the plurality of power connections. The maximum voltage on the data signal line may correspond to a maximum luminance of the light emitting diode and a minimum voltage on the data signal line may correspond to zero luminance of the light emitting diode. The voltage on the negative connection may be greater than or equal to the total of the negative of a mimimun threshold voltage of the first transistor and the negative of an illumination onset voltage of the light emitting diode. A voltage on a reverse bias connection of the plurality of power connections may be less than the negative of a maximum threshold voltage of the first transistor.

The time period for setting $V_t$ may be between approximately 100 microseconds and 200 microseconds. The method may further include turning on the second transistor at a beginning of the time period, turning off the second transistor at a predetermined point after the beginning and before an end of the time period, turning on the first transistor at the same time that the second transistor is turned off, and turning a third transistor associated with each pixel on and off at the same time that the second transistor is turned on and off, respectively. The light emitting diode may include organic material, and the first and second transistors may include thin-film transistors made from amorphous silicon. The plurality of signal lines may include a data signal line, a gate signal line, an on/off signal line, and a reverse bias voltage signal line. The plurality of power connections may include a positive connection, a negative connection and reverse bias connection, and the method may further include maintaining the respective voltage levels of the positive, negative and reverse bias connections during the time period for establishment of the threshold voltage on the storage capacitor.

Another active matrix display, in accordance with the present invention, includes a plurality of pixels arranged in an array, at least three transistors associated with each pixel, the at least three transistors positioned within the array for controlling current flow through each pixel, a light emitting diode associated with each pixel, and a storage capacitor associated with each pixel, wherein, during a time period for establishment of a threshold voltage on the storage capacitor for a first transistor of the at least three transistors, a voltage of the storage capacitor is set to a voltage including the threshold voltage and a voltage for compensating for turnoff of a second transistor of the at least three transistors.

Another method for obtaining threshold voltage compensation in pixels of an active matrix display, in accordance with the present invention, includes providing a plurality of pixels arranged in an array, wherein each pixel includes at least three transistors, a light emitting diode, and a storage capacitor associated therewith, positioning the at least three transistors within the array for controlling current flow through each pixel, and establishing, during a time period for establishment of a threshold voltage of a first transistor of the at least three transistors on the storage capacitor, a voltage for compensating for turnoff of a second transistor of the at least three transistors on the storage capacitor.

A pixel circuit for an active matrix display, in accordance with the present invention, includes at least three transistors for controlling current flow through a pixel, a light emitting diode, a plurality of signal lines for carrying signals for controlling the at least three transistors, a plurality of power connections for supplying power to the pixel, and a storage capacitor, wherein, during a time period for establishment of a threshold voltage on the storage capacitor for a first transistor of the at least three transistors, a voltage equal to the sum of the threshold voltage and a voltage for compensating for turnoff of a second transistor of the at least three transistors is established on the storage capacitor.

BRIEF DESCRIPTION OF THE DRAWINGS

Preferred embodiments of the invention can be understood in more detail from the following descriptions taken in conjunction with the accompanying drawings in which.

DETAILED DESCRIPTION OF THE PREFERRED EMBODIMENTS

Preferred embodiments of the present invention will be described below in more detail with reference to the accompanying drawings. This invention may, however, be embodied in different forms and should not be construed as limited to the embodiments set forth herein. Rather, these embodiments are provided so that this disclosure will be thorough and complete, and will fully convey the scope of the invention to those skilled in the art.

Figure 1:
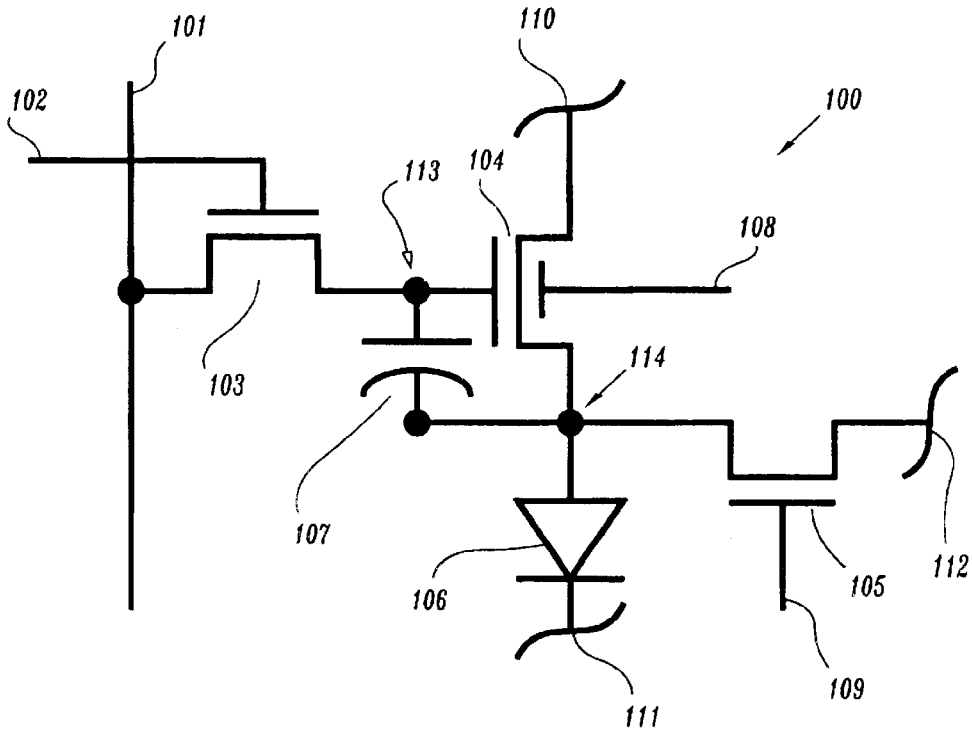
FIG. 1 shows a threshold voltage ($V_t$) compensation AMOLED pixel circuit, according to an embodiment of the present invention.

Referring now to the drawings, FIG. 1 shows an AMOLED pixel circuit suitable for fast threshold voltage ($V_t$) compensation without switching of the cathode voltage. The AMOLED pixel circuit 100 has four signal inputs 101, 102, 108 and 109; specifically, a data signal input 101 for carrying a column signal presenting analog voltage data i.e., converted image data, a gate signal input 102 for carrying a row addressing logic signal for writing data, an on/off signal input 108 for carrying a logic signal for allowing or preventing current flow by, for example, turning a thin-film transistor (TFT) on or off, and a reverse bias voltage signal input 109 for carrying a logic signal for establishing a reverse bias voltage. Data signal input 101 and gate signal input 102 are common column and row active matrix display pixel addressing signal inputs known to those of ordinary skill in the art for writing data or an image to a display. The gate lines (rows) are sequentially addressed, typically from the top to the bottom of the display, while data for each row is presented on the data lines (columns). The on/off signal input 108 and reverse bias voltage signal input 109 are non-addessing signal inputs since these signals are not directly involved with writing data to the pixels in the display.

Circuit 100 has three power supply connections or steady voltage connections, including a positive supply voltage connection 110, a negative supply voltage connection 111 and a reverse bias voltage connection 112. Circuit 100 also includes an OLED 106, a storage capacitor 107, and TFTs 103, 104 and 105. The OLED is made from organic material, including, for example, an electron transport and emitting layer made from tris(8-hydroxyquinolinato)aluminim ($Alq_3$), and a hole transport layer made from N,N'-di (naphthalene-1-y-1)-N,N'diphenyl-benzidine (NPB). TFTs 103, 104 and 105 are made from, for example, amorphous silicon (a-Si).

As set forth herein, the storage capacitor 107 represents the parallel combination of a gate to source capacitor of TFT 104 and any additional storage capacitors in the circuit. In situations where the gate to source capacitance of the TFT 104 is sufficiently large, additional storage capacitors may be eliminated. Therefore, for purposes of this application, a "storage capacitor" encompasses the gate to source capacitor of TFT 104 and any additional storage capacitors in the circuit that are in combination with the gate to source capacitor of TFT 104. Further, a capacitance or a voltage on or across the storage capacitor means a capacitance or voltage on or across the gate to source capacitor of TFT 104 and any additional storage capacitors in the circuit that are in combination with the gate to source capacitor of TFT 104.

The OLED 106 has an anode connected to circuit node 114 and a cathode connected to the negative power supply connection 111. TFT 103 and TFT 105 are bottom gate fabricated TFTs, including only bottom gates. The bottom gate of TFT 103 is connected to gate input 102. Data input 101 is connected to a drain/source contact of TFT 103. The bottom gate of TFT 105 is connected to the reverse bias voltage signal input 109. TFT 104 is fabricated with both a bottom gate and a top gate. The bottom gate of TFT 104 is connected to circuit node 113 and the top gate of TFT 104 is connected to the on/off signal input 108. The top gate of TFT 104 operates as a depletion gate, stopping drain to source current with a logic low input signal (e.g. "0") from the on/off signal input 108. A logic high input signal (e.g. "1") from the on/off signal input 108 allows drain to source current to flow as determined by the bottom gate to source voltage.

In a preferred embodiment, the positive supply voltage (i.e., the voltage at the positive supply voltage connection 110) is greater (more positive) than or equal to the maximum data voltage on data signal input 101 plus the maximum voltage on OLED 106 and the voltage at the negative supply terminal 111. For example, when the maximum data voltage is +10V, the maximum OLED voltage is +7.5V and the negative supply voltage is −4.5V, then the positive supply voltage≧10+7.5−4.5=13V. The negative supply voltage is greater than or equal to the negative of the minimum $V_t$ of TFT 104 and the negative of the illumination onset voltage of OLED 106. The illumination onset voltage is the minimum voltage at which OLED 106 emits light. For example, when the minimum $V_t$ of TFT 104 is 2.5 V and the illumination onset voltage of OLED 106 is 2 V, then the negative supply voltage≧−2.5−2=4.5V.

The reverse bias voltage (i.e., the voltage at the reverse bias voltage connection 112) is less than the negative of the maximum $V_t$ of TFT 104, for example, −8V. Therefore, the reverse bias voltage may be approximately −12V or less. The minimum voltage on data signal input 101 is 0V or ground. The maximum voltage on data signal input 101 corresponds to the maximum luminance for OLED 106, while the minimum voltage on data signal input 101 corresponds to zero luminance for OLED 106.

Figure 2:
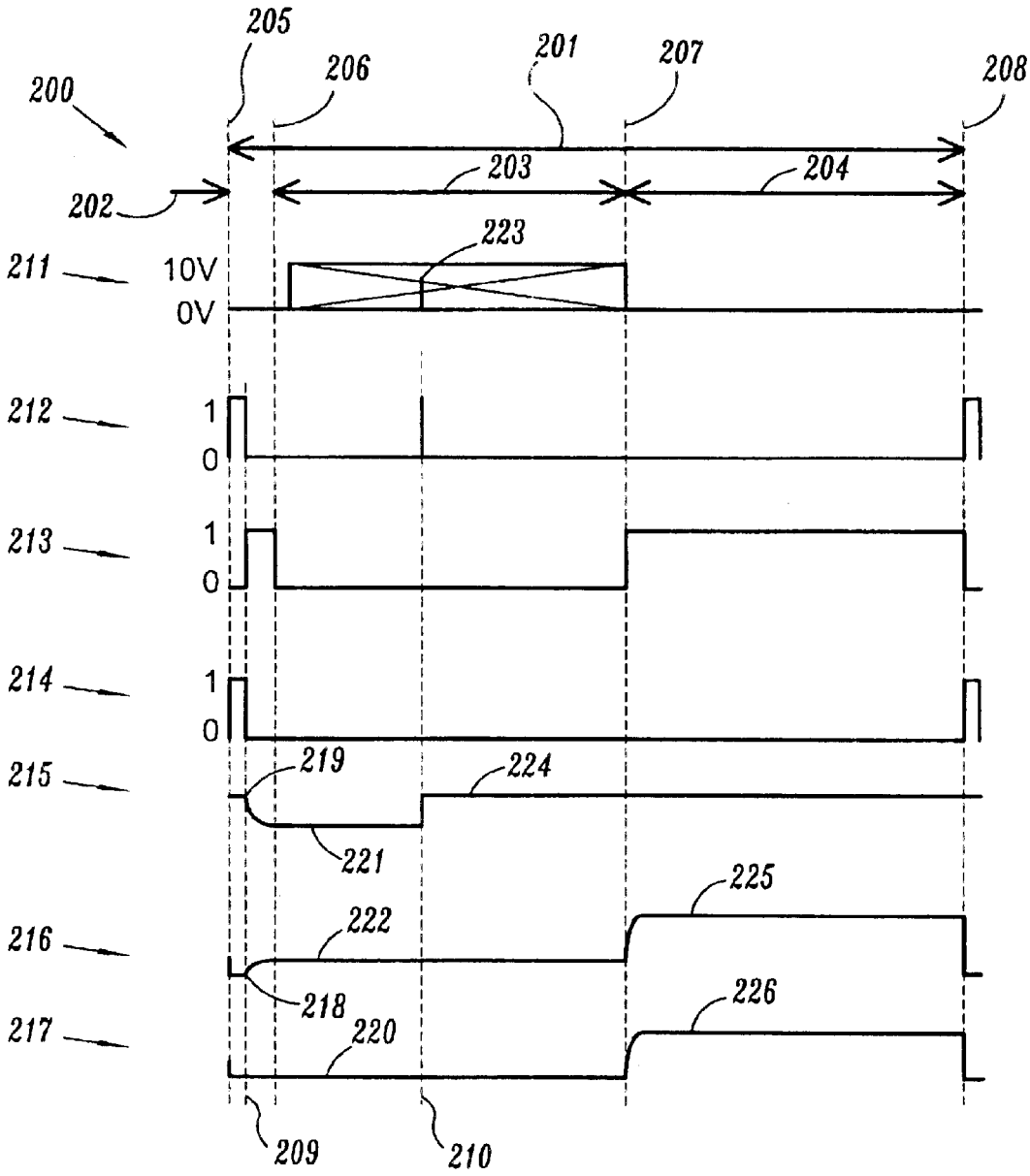
FIG. 2 shows a timing diagram representing operation of the $V_t$ compensation AMOLED pixel circuit of FIG. 1.

FIG. 2 shows a signal timing diagram 200 representing operation of the pixel circuit 100 for faster $V_t$ compensation. Frame time period 201 is divided into write $V_t$ time period 202, write data time period 203 and expose time period 204. The frame time period 201 is the time between time 205 and time 208. The write $V_t$ time period 202 is the time between time 205 and time 206. The write data time period 203 is the time between time 206 and time 207. The expose time period 204 is the time between time 207 and time 208. A second frame time period starts at the end of a first frame time period. Typically, frame time period 201 may be approximately 16.7 milliseconds. The write data period 203 and the expose time period 204 each may be approximately 8.3 milliseconds. While dependent upon TFT mobility, TFT channel width to length ratios, data storage capacitance, circuit voltages and desired accuracy, the write $V_t$ period 202 may be approximately 0.1 to 0.2 milliseconds.

Data signal 211 corresponds to the signal on data signal input 101 in circuit 100. Gate signal 212 is the signal on gate signal input 102 in circuit 100. The signal on the on/off signal input 108 is represented by on/off signal 213. The signal on reverse bias voltage signal input 109 is depicted as the reverse bias signal 214. The voltage across storage capacitor 107 is shown as the capacitor voltage 215. The anode to cathode voltage across OLED 106 is depicted as OLED voltage 216. The luminance of OLED 106 is shown by OLED luminance 217.

At time 205, the beginning of the write $V_t$ time period 202, gate signal 212 and reverse biase signal 214 are set to the logic high state ("1") and the data signal 211 on data signal input 101 is 0V. The high logic state of gate signal 212 turns TFT 103 on, thereby connecting the data signal 211 with circuit node 113. The high logic state of reverse bias signal 214 turns TFT 105 on, thereby connecting circuit node 114 to the reverse bias voltage terminal 112. This operation reverse biases the OLED 106 to voltage 218 and sets the voltage on storage capacitor 107 to a voltage greater than or equal to the maximum $V_t$ of TFT 104, shown as voltage 219. At time 205, OLED 106 is generating zero luminance, which is shown as luminance 220. The time required for this operation may be approximately 10 microseconds.

At time 209, gate signal 212 and reverse bias signal 214 are set to the logic low state ("0"), thereby turning off TFT 103 and TFT 105. At time 209, on/off signal 213 is set to the logic high state ("1"). The high logic state of on/off signal 213 allows TFT 104 to conduct a current. The voltage across storage capacitor 107, i.e., capacitor voltage signal 215, discharges to voltage 221 and the voltage across OLED 106 increases to voltage 222. The voltage across storage capacitor 107 discharges, as allowed by the remaining time in the write $V_t$ time period 202, to a point so as to leave excess voltage on the capacitor 107 to compensate for turnoff of TFT 103. Therefore, voltage 221 is equal to $V_t$ plus the TFT 103 turnoff correction voltage. Accordingly, the write $V_t$ time period is much less than if the voltage of the storage capacitor 107 discharged to $V_t$ without compensating for turnoff of TFT 103. At the end of the write $V_t$ time period 202, on/off signal 213 is set to the low logic state. Voltage 222 is less than the illumination onset voltage of OLED 106.

At the beginning of gate time period 210, which occurs during the write data time period 203, gate signal 212 is set to the logic high state and data signal 211 has voltage 223. Voltage 223 is written onto circuit node 113. Since capacitance of OLED 106 is much larger than the capacitance of storage capacitor 107 and TFT 104 is not allowed to conduct a current due to the logic low state of on/off signal 213, voltage 222 does not change significantly. At the end of gate time period 210 (i.e. time 207), gate signal 212 is set the logic low state, leaving voltage 223 on circuit node 113. The voltage across storage capacitor 107, i.e., voltage 224, is voltage 223 plus $V_t$.

At the beginning of expose time period 204 (i.e., time 207), on/off signal 213 is set the logic high state, allowing TFT 104 to conduct a current. TFT 104 operates in saturation. Accordingly, the current through TFT 104 is proportional to the square of voltage 223. The current through TFT 104 increases the voltage across OLED 106 to voltage 225 and the current through TFT 104 flows into and through OLED 106 to produce luminance 226. Since the luminance of OLED 106 is proportional to the current flowing through OLED 106, the luminance of OLED 106 is also proportional the square of voltage 223.

Figure 3:
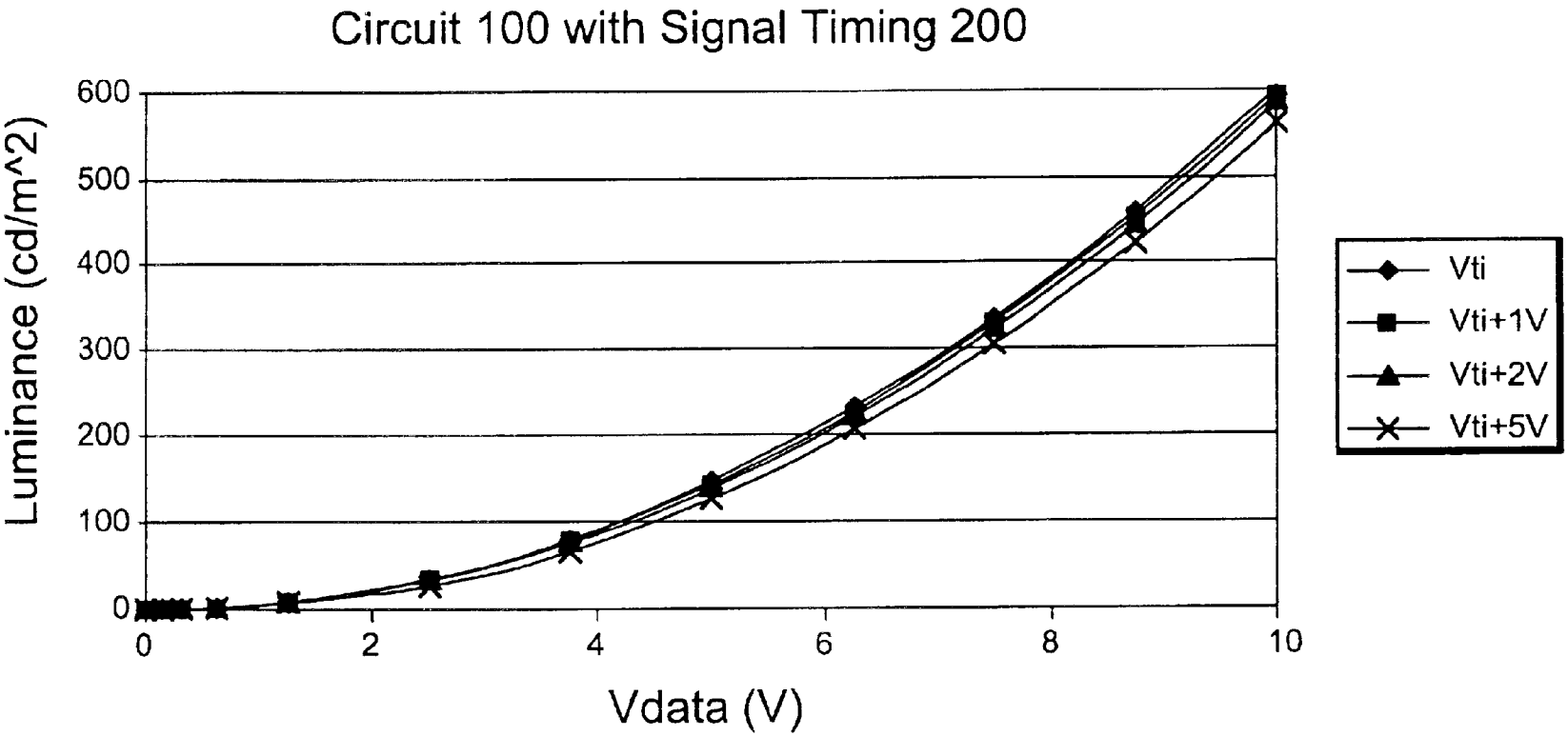
FIG. 3 shows an OLED luminance transfer function with input data voltage ($V_{data}$) and initial threshold voltage ($V_{ti}$), and with $V_{ti}$ increased by 1V, 2V and 5V, according to an embodiment of the present invention.

Circuit simulations have been performed to determine the degree to which circuit 100 compensates for variations in $V_t$. FIG. 3 shows the data voltage ($V_{data}$) to luminance transfer function of circuit 100 having signal timing 200 for TFT 104 having an initial threshold voltage ($V_{ti}$), and $V_{ti}$ increased by 1, 2 and 5V ($V_{ti}$+1V, $V_{ti}$+2$V_{ti}$ and $V_{ti}$+5V). The four curves nearly overlay one another. However, some luminance loss is observed with increasing $V_t$.

Figure 4:
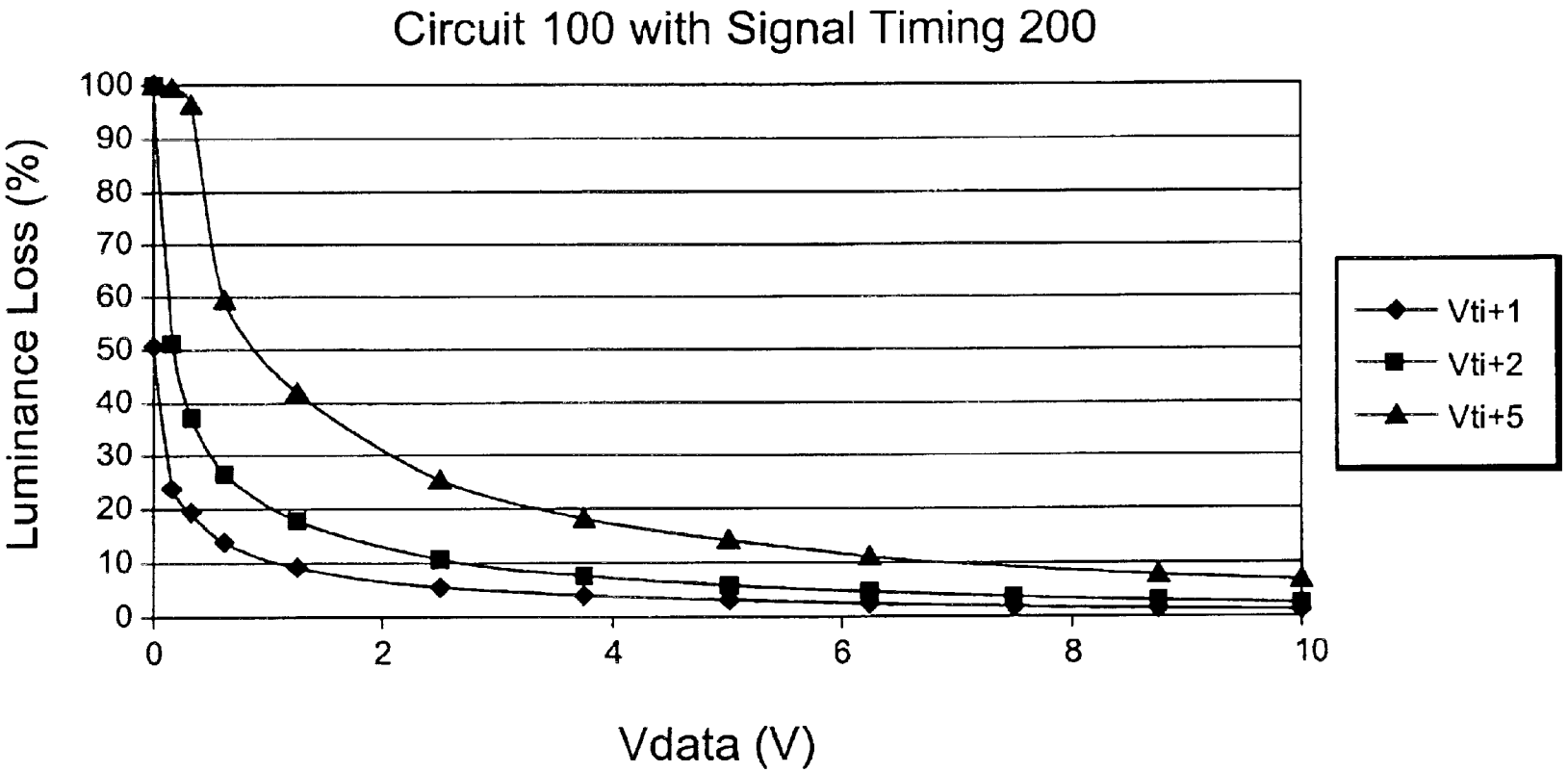
FIG. 4 shows the percent luminance loss as a function of $V^{data}$ as $V_{ti}$ is increased by 1V, 2V and 5 V.

The percent luminance loss is shown in FIG. 4. At low luminance, the percent luminance loss is large. While at high luminance the percent luminance loss is small. For $V_{data}$= 10V, the percent luminance degradtion is 1.3%, 2.7% and 6.8% for $V_{ti}$+1V, $V_{ti}$+2V and $V_{ti}$+5V, respectively. If circuit 100 were addressed with a constant high logic state on the on/off signal input 108 and a constant low logic state on the reverse bias voltage signal input 109, the percent luminance loss for $V_{data}$=10V for $V_{ti}$+1V, $V_{ti}$+2V and $V_{ti}$+5V is 20%, 40% and 80%, respectively. Therefore, operating circuit 100 in accordance with the signal timing diagram 200 results in reducing the loss by 10× to 20×as $V_t$ increases over time.

Simulations show that voltages 221 and 222 are established in much shorter time than with conventional designs due to: 1) a much larger drain to source voltage across TFT 104 than with previous implementations; and 2) providing a correction voltage when TFT 103 is turned off. The $V_t$ is established on storage capacitor 107 in ~150 microseconds, which is much faster than the ~1 millisecond previously achieved with prior designs.

In previous implementations, the drain to source voltage across a TFT would be equal the voltage across a storage capacitor. However, in circuit 100, the drain to source voltage of TFT 104 is, for example, 13V higher than the voltage across the storage capacitor 107. Further, while TFTs in both the previous implementation and circuit 100 operate in the saturation regime, the drain to source current through TFT 104 in circuit 100 will be higher. The increase in drain to source current through the TFT 104 is due to channel length modulation with voltage, whereby an increase in the drain to source voltage results in a shorter channel length and, accordingly, an increased drain to source current.

With the earlier implementations, the voltage on the storage capacitor was increased due to a decrease in the cathode voltage at the beginning of an expose time period and stray capacitance on a circuit node. The change in cathode voltage occurred to compensate for turnoff of the gate to source voltage coupling a TFT when data was written onto the storage capacitor. By contrast, in circuit 100 operating in accordance with signal timing diagram 200, an excess voltage on capacitor 107 compensates for turnoff of TFT 103 when data is written. Accordingly, the voltage on capacitor 107 is not discharged to the same extent as in previous implementations, so as to leave the excess voltage on the capacitor 107 to compensate for turnoff of TFT 103. Therefore, there is no change in cathode voltage to compensate for TFT turnoff. Instead, the excess voltage left on storage capacitor 107 corrects for turnoff of TFT 103. This results in a shorter write $V_t$ time period 202 than in previous designs since the time required to set or discharge the storage capacitor voltage to $V_t$ plus the TFT 103 turnoff correction voltage is much less than the time to set the storage capacitance voltage to $V_t$. The time between times 209 and 206 is decreased to allow for this correction.

Note that circuit 100 operated in accordance with signal timing diagram 200 does not switch voltages on the negative power supply connection 111, the cathode connection to OLED 106, or on positive power supply connection 110 to establish the $V_t$ on storage capacitor 107. Further, the on/off signal input 108 and the reverse bias signal input 109 (i.e., the non-addressing inputs) may be common to all pixels in the display. Since the voltage terminals 110, 111, and 112 do not switch or change voltage levels and the additional control inputs 108 and 109 are common, the display system structure may be much simpler than previous implementations.

Although the illustrative embodiments have been described herein with reference to the accompanying drawings, it is to be understood that the present invention is not limited to those precise embodiments, and that various other changes and modifications may be affected therein by one of ordinary skill in the related art without departing from the scope or spirit of the invention. All such changes and modifications are intended to be included within the scope of the invention as defined by the appended claims.

What is claimed is:

1. An active matrix display, comprising:

a plurality of pixels arranged in an array;

a first transistor and a second transistor associated with each pixel, the first and second transistors positioned within the array for controlling current flow through each pixel;

a light emitting diode associated with each pixel; and a storage capacitor associated with each pixel, wherein, during a time period for establishment of a threshold voltage on the storage capacitor for the first transistor, a voltage equal to the sum of the threshold voltage and a voltage for compensating for turnoff of the second transistor is established on the storage capacitor.

2. The display as recited in claim 1, further comprising:

a plurality of signal lines associated with each pixel for carrying signals for controlling the first and second transistors; and a plurality of power connections associated with each pixel for supplying power to each pixel.

3. The display as recited in claim 2, wherein a voltage on a positive connection of the plurality of power connections is greater than or equal to the total of a maximum voltage on a data signal line of the plurality of signal lines, a maximum voltage on the light emitting diode, and a voltage on a negative connection of the plurality of power connections.

4. The display as recited in claim 3, wherein the maximum voltage on the data signal line corresponds to a maximum luminance of the light emitting diode.

5. The display as recited in claim 3, wherein a minimum voltage on the data signal line corresponds to zero luminance of the light emitting diode.

6. The display as recited in claim 3, wherein the voltage on the negative connection is greater than or equal to the total of the negative of a mimimun threshold voltage of the first transistor and the negative of an illumination onset voltage of the light emitting diode.

7. The display as recited in claim 3, wherein a voltage on a reverse bias connection of the plurality of power connections is less than the negative of a maximum threshold voltage of the first transistor.

8. The display as recited in claim 1, wherein the time period is between approximatley 100 microseconds and 200 microseconds.

9. The display as recited in claim 1, wherein the second transistor is turned on at a beginning of the time period and turned off at a predetermined point after the beginning and before an end of the time period.

10. The display as recited in claim 9, wherein the first transistor is turned on at the same time that the second transistor is turned off.

11. The display as recited in claim 9, further comprising a third transistor associated with each pixel that is turned on and off at the same time that the second transistor is turned on and off, respectively.

12. The display as recited in claim 1, wherein a voltage on the storage capacitor is reduced to establish the voltage equal to the sum of the threshold voltage for the first transistor and the voltage for compensating for turnoff of the second transistor.

13. The display as recited in claim 1, wherein the light emitting diode includes organic material.

14. The display as recited in claim 1, wherein the first and second transistors include thin-film transistors.

15. The display as recited in claim 14, wherein the thin-film transistors are made from amorphous silicon.

16. The display as recited in claim 2, wherein the plurality of signal lines includes a data signal line, a gate signal line, an on/off signal line, and a reverse bias voltage signal line.

17. The display as recited in claim 2, wherein:

the plurality of power connections includes a positive connection, a negative connection and reverse bias connection; and the positive, negative and reverse bias connections do not change their respective voltage levels during the time period for establishment of the threshold voltage on the storage capacitor.

18. A method for obtaining threshold voltage compensation for an active matrix display, comprising:

providing a plurality of pixels arranged in an array, wherein each pixel includes a first transistor, a second transistor, a light emitting diode, and a storage capacitor associated therewith;

positioning the first and second transistors within the array for controlling current flow through each pixel; and establishing on the storage capacitor a voltage equal to the sum of a threshold voltage for the first transistor and a voltage for compensating for turnoff of the second transistor.

19. The method as recited in claim 18, wherein the step of establishing occurs during a time period for establishment of the threshold voltage for the first transistor.

20. The method as recited in claim 18, wherein each pixel includes a plurality of signal lines associated therewith for carrying signals for controlling the first and second transistors, and each pixel includes a plurality of power connections associated therewith for supplying power to each pixel.

21. The method as recited in claim 20, wherein a voltage on a positive connection of the plurality of power connections is greater than or equal to the total of a maximum voltage on a data signal line of the plurality of signal lines, a maximum voltage on the light emitting diode, and a voltage on a negative connection of the plurality of power connections.

22. The method as recited in claim 21, wherein the maximum voltage on the data signal line corresponds to a maximum luminance of the light emitting diode.

23. The method as recited in claim 21, wherein a minimum voltage on the data signal line corresponds to zero luminance of the light emitting diode.

24. The method as recited in claim 21, wherein the voltage on the negative connection is greater than or equal to the total of the negative of a mimimun threshold voltage of the first transistor and the negative of an illumination onset voltage of the light emitting diode.

25. The method as recited in claim 21, wherein a voltage on a reverse bias connection of the plurality of power connections is less than the negative of a maximum threshold voltage of the first transistor.

26. The method as recited in claim 19, wherein the time period is between approximatley 100 microseconds and 200 microseconds.

27. The method as recited in claim 19, further comprising:

turning on the second transistor at a beginning of the time period; and turning off the second transistor at a predetermined point after the beginning and before an end of the time period.

28. The method as recited in claim 27, further comprising turning on the first transistor at the same time that the second transistor is turned off.

29. The method as recited in claim 27, further comprising turning a third transistor associated with each pixel on and off at the same time that the second transistor is turned on and off, respectively.

30. The method as recited in claim 18, wherein the light emitting diode includes organic material.

31. The method as recited in claim 18, wherein the first and second transistors include thin-film transistors.

32. The method as recited in claim 31, wherein the thin-film transistors are made from amorphous silicon.

33. The method as recited in claim 20, wherein the plurality of signal lines includes a data signal line, a gate signal line, an on/off signal line, and a reverse bias voltage signal line.

34. The method as recited in claim 20, wherein the plurality of power connections includes a positive connection, a negative connection and reverse bias connection, and the method further comprises maintaining the respective voltage levels of the positive, negative and reverse bias connections during the time period for establishment of the threshold voltage on the storage capacitor.

35. An active matrix display, comprising:

a plurality of pixels arranged in an array;

at least three transistors associated with each pixel, the at least three transistors positioned within the array for controlling current flow through each pixel;

a light emitting diode associated with each pixel; and a storage capacitor associated with each pixel, wherein, during a time period for establishment of a threshold voltage on the storage capacitor for a first transistor of the at least three transistors, a voltage of the storage capacitor is set to a voltage including the threshold voltage and a voltage for compensating for turnoff of a second transistor of the at least three transistors.

36. A method for obtaining threshold voltage compensation for an active matrix display, comprising:

providing a plurality of pixels arranged in an array, wherein each pixel includes at least three transistors, a light emitting diode, and a storage capacitor associated therewith;

positioning the at least three transistors within the array for controlling current flow through each pixel; and establishing, during a time period for establishment of a threshold voltage of a first transistor of the at least three transistors on the storage capacitor, a voltage for compensating for turnoff of a second transistor of the at least three transistors on the storage capacitor.

37. A pixel circuit for an active matrix display, comprising:

at least three transistors for controlling current flow through a pixel;

a light emitting diode;

a plurality of signal lines for carrying signals for controlling the at least three transistors;

a plurality of power connections for supplying power to the pixel; and a storage capacitor, wherein, during a time period for establishment of a threshold voltage on the storage capacitor for a first transistor of the at least three transistors, a voltage equal to the sum of the threshold voltage and a voltage for compensating for turnoff of a second transistor of the at least three transistors is established on the storage capacitor.

* * * * *